US007952283B2

(12) United States Patent
Böröczki et al.

(10) Patent No.: US 7,952,283 B2
(45) Date of Patent: May 31, 2011

(54) HIGH INTENSITY DISCHARGE LAMP WITH IMPROVED CRACK CONTROL AND METHOD OF MANUFACTURE

(75) Inventors: Ágoston Böröczki, Körakás park (HU); Ferenc Buda, Szarvas köz (HU); Csaba Horváth, Juhász Gyula utca (HU)

(73) Assignee: General Electric Company, Schenectady, NY (US)

( * ) Notice: Subject to any disclaimer, the term of this patent is extended or adjusted under 35 U.S.C. 154(b) by 893 days.

(21) Appl. No.: 11/270,143

(22) Filed: Nov. 9, 2005

(65) Prior Publication Data

US 2007/0103081 A1 May 10, 2007

(51) Int. Cl.
*H01J 17/04* (2006.01)

(52) U.S. Cl. ..... 313/631; 313/623

(58) Field of Classification Search ..... 313/623, 313/631

See application file for complete search history.

(56) References Cited

U.S. PATENT DOCUMENTS

| | | | | |
|---|---|---|---|---|
| 5,461,277 | A | 10/1995 | Van Gennip et al. | |
| 5,614,787 | A * | 3/1997 | Kawai et al. | 313/623 |
| 5,905,340 | A | 5/1999 | Karlotski et al. | |
| 5,936,350 | A * | 8/1999 | Yoshida et al. | 313/631 |
| 6,891,332 | B1 * | 5/2005 | Irisawa et al. | 313/631 |
| 7,671,536 | B2 * | 3/2010 | Takagaki et al. | 313/631 |
| 2001/0005117 | A1 * | 6/2001 | Nishida et al. | 315/111.11 |
| 2002/0190654 | A1 * | 12/2002 | Kanzaki et al. | 313/623 |
| 2003/0042856 | A1 | 3/2003 | Kaneko et al. | |
| 2003/0048076 | A1 | 3/2003 | Kanzaki et al. | |
| 2004/0183443 | A1 | 9/2004 | Bittmann et al. | |

FOREIGN PATENT DOCUMENTS

| | | | |
|---|---|---|---|
| EP | 1465235 | A2 | 10/2004 |
| JP | 59128753 | A2 | 7/1984 |
| JP | 10106492 | A2 | 4/1998 |
| JP | 10241630 | A2 | 9/1998 |
| WO | 2006082539 | A2 | 8/2006 |
| WO | 2006099850 | A2 | 9/2006 |

* cited by examiner

*Primary Examiner* — Peter Macchiarolo
(74) *Attorney, Agent, or Firm* — Fay Sharpe LLP

(57) ABSTRACT

A high intensity discharge lamp comprises an arc tube, which encloses an arc chamber. The arc chamber contains a gas fill and the arc tube is terminated by at least one sealed portion. The sealed portions enclose an electrode assembly. The electrode assembly comprises an electrode, a lead-in wire and an electrically conducting foil. The electrode extends into the arc chamber. The lead-in wire extends outward from the sealed portion for providing electric contact with a power supply. The electrically conducting foil connects the lead-in wire and the electrode and provides a sealed electric connection through a sealed portion of the arc tube. At least one of the electrodes is provided with surface irregularities in a region between the foil and the arc chamber in order to control shape and size of cracks in a seal wall surrounding the electrodes.

In the method, an electrode of predetermined geometry and structure is provided with at least one artificial surface irregularity. Subsequently, an electrode assembly comprising said electrode, a seal foil and a lead-in wire is prepared. The electrode assembly is introduced into an arc chamber, the arc chamber is closed with a seal, and the electrode assembly is sealed therein, so that the irregularities of the electrode are formed in a region between the foil and the arc chamber. The electrodes may be provided with artificial surface irregularities also after preparing the electrode assembly.

24 Claims, 3 Drawing Sheets

HIGH INTENSITY DISCHARGE LAMP WITH IMPROVED CRACK CONTROL AND METHOD OF MANUFACTURE

FIELD OF THE INVENTION

The invention relates to a high intensity discharge lamp with improved crack control and method of manufacture thereof.

BACKGROUND OF THE INVENTION

Discharge lamps in general have a discharge volume enclosed by a discharge vessel, which is filled with a discharge gas comprising typically inert gases and additives necessary to sustain discharge inside the discharge vessel. The discharge takes place typically between electrodes, which extend into the discharge volume and are generally of tungsten, tungsten alloy with or without a further additive or sheath. The electrodes are held and surrounded by the glass material of the discharge vessel in a seal portion. In order to achieve vacuum tight seal, the electrode is configured as a three part electrode assembly comprising an internal part, the actual electrode, an external part (also called the lead-in wire) for connecting the electrode to an external power supply and a seal foil made of a thin metal foil which is electrically connected to both of the electrode and the lead-in wire.

Discharge lamps find application in all areas of lighting technology from home lighting (Metal Halide Lamps) to automobile headlights (High Intensity Discharge Lamps).

High Intensity Discharge (HID) lamps include mercury vapor lamps, (HPM) sodium lamps (HPS), metal halide lamps (MH) and xenon lamps. Xenon lamps are mainly used in projectors because of their high lumen output. In the automotive industry, it is vital to have lamps with a long lifetime, high efficiency and a quick start. HID lamps suitable for automobile reflectors are obtained as a combination of metal halide and xenon lamps. When starting these reflector lamps, the xenon fill in the lamp provides for a quick start and the metal halide fill in the lamp provides for a high efficiency during operation. In the starting period, high voltage pulse trains are used in order to cause a breakdown in the discharge gas between the electrodes. The current flowing through the lamp causes the cathode to reach temperatures typically of 2500° C. Due to the changes of temperature of the cathode over a wide range and the difference of the thermal expansion of the cathode material (usually tungsten) and the seal material (usually quartz glass) cracks are formed in the seal material. Such cracks may propagate to the outer surface causing a communication channel between the inner volume of the envelope and the outer atmosphere. Frequently, such crack propagation due to the mechanical stresses caused by high temporal and spatial thermal gradients at the contact area of the electrodes and the discharge vessel wall leads to leaking channel formation where the high pressure fill material and additives of the discharge vessel are lost, and finally the lamp fails to operate.

Conventionally, the arc tube of a high intensity discharge (HID) lamp, and especially that of a standard metal halide lamp or an HID lamp intended for automotive applications is made of fused silica (quartz glass). An example for the construction of such an arc tube is given in FIG. 1. In the shown example, the arc tube consists of a center portion, the arc chamber 2, where the electric discharge is taking place during lamp operation. The arc chamber is enclosed by an envelope 1 and sealed in a vacuum tight manner at the end portion(s) of the arc tube, that is by the seals or pinch sections 3, also containing the electrode assembly, which is responsible for leading the electric current through the seal. In order to ensure vacuum tightness, the electrode assembly generally consists of three parts as shown in FIG. 1. The electrode 4 shank is usually made of tungsten and ejects charge carriers (electrons) into the discharge plasma. A very thin (some tens of micrometer at maximum) metal seal foil 6 usually made of molybdenum ensures the vacuum tightness of the seal by its plastic and elastic deformations. A metallic lead-in wire 5 of the electrode assembly connects the arc tube to a power supply and may be made of molybdenum.

The temperature of the glass to metal seal area 3 of high intensity discharge (HID) lamps with arc tubes of high wall load can considerably be higher than that of the standard HID lamp products. Wall load means the ratio of the power consumed by the lamp under steady state operation and the arc chamber outer surface area between the two electrode tips. The elevated pinch temperature can adversely affect lamp life, especially in the case of metal halide lamps. For these lamps, one of the main lifetime limiting factors is the kinetics of the chemical reactions between the metal components in the seal—e.g. the molybdenum current leading seal foil 6—and the metal halide dose constituents from the arc chamber. The higher the temperature of the reacting components is, the most severe the effect of these chemical reactions on lamp life.

In general, the requirements with respect to HID lamps with high in-rush and/or steady-state operating currents are extremely high. This is especially true in the case of HID automotive lamps, where the additional requirements of "instant light" generation and "hot re-start" ability imply heavy lamp currents and power overload during the starting and run-up periods of lamp operation. Consequently during the run-up phase, a large part of the electrode bodies are running at much higher temperatures compared to the steady-state conditions. This results in extremely high electrode temperatures at the electrode-to-arc tube wall interface area (at the electrode foot-point), while the surrounding discharge vessel wall temperature is still relatively low.

The high spatial and temporal temperature gradients in the vessel wall surrounding the hot electrode that is in the sealing sections responsible for vacuum-tight closing of the discharge vessel, lead to high mechanical stress levels. The thermally induced additional mechanical stresses can generate micro crack propagation in the pinch seal sections having the glass layered electrode shank when the lamps are repetitively started and then switched off. This is because the shape and dimensions of the micro cracks generated by the thermal expansion mismatch between the electrode and the surrounding glass is very difficult to control. The final result is leaking channel generation where filling gas and dosing constituents of the discharge chamber are lost, and the lamp becomes inoperative. Such early failures or short-life lamp samples severely affect lamp life performance and reliability. Ultimately road safety is affected in a negative way, and maintenance costs are increased.

In order to prevent the fill material from accessing the molybdenum foil 4 in the seal, a quartz glass layer formation around the electrode shank was proposed by U.S. Pat. No. 5,461,277 issued to Van Gennip et al. According to this patent, a glass layer formed on the electrode eliminates the wide channels around the electrode shank, which can usually be observed in conventional discharge lamps. The glass layer is being formed by cracking of the discharge vessel wall around the electrode due to the thermal expansion coefficient mismatch between the quartz glass and the tungsten electrode shank. The advantage of the glass layer comes from the much smaller width of these micro cracks, compared to the ordinary channels around the electrode shank without the proposed glass layer on it. The suggested glass layer structure is a good solution, however it is very difficult to achieve the suggested ideally symmetrical and regular structure, which is necessary in order to avoid crack propagation to the surface. The suggested precise shape and structure can only be achieved by a very expensive manufacturing process and even though a high amount of waste products will be produced. Even the tiniest irregularity in shape and structure of the suggested glass layer may lead to generation of an unwanted crack structure which would propagate to the surface of the surrounding glass wall.

Further, U.S. Pat. No. 5,905,340 discloses a HID lamp with treated electrode. The electrodes are heat treated with high heat, strong vacuum and over an extended period of time before being assembled together to an electrode assembly. In result of the heat treatment, the electrodes will be partially or completely re-crystallized and the out-gas-able components will be removed in order to provide for a better adhesion between the electrode and the seal wall material and to reduce crack failure of HID lamps. This method and the resulting electrode is much too expensive for mass production and the time-consuming heat treating makes the manufacturing process difficult and ineffective. In addition to this, it is not guaranteed that the crack pattern is constant with a controlled crack form.

Thus, there is a particular need for a HID lamp with an electrode seal structure, which is capable of resisting high thermal and mechanical stress due to repeated starting of the lamps and with improved reliability and longer product life. Although micro cracks in the seal region cannot be avoided, it is desirable to have control over the shape and dimensions of the micro cracks in order to avoid micro crack propagation to the outer surface of the HID lamp wall.

SUMMARY OF THE INVENTION

In an exemplary embodiment of the present invention, there is provided a high intensity discharge lamp, which comprises an arc tube enclosing an arc chamber. The arc chamber contains a gas fill and the arc tube is terminated by at least one sealed portion. The sealed portions enclose at least one electrode assembly. The electrode assembly comprises an electrode, a lead-in wire and an electrically conducting foil. The electrode extends into the arc chamber. The lead-in wire extends outward from the sealed portion for providing electric contact with a power supply. The electrically conducting foil connects the lead-in wire and the electrode and provides a sealed electric connection through a sealed portion of the arc tube. At least one of the electrodes is provided with at least one artificial surface irregularity in a region between the foil and the arc chamber in order to control shape and size of cracks in a seal wall surrounding the electrodes.

In an exemplary embodiment of another aspect of the invention, there is also proposed a method for manufacturing a high intensity discharge lamp. In this method, there is provided an electrode of predetermined length, geometry and structure. The electrode is provided with at least one artificial surface irregularity. An electrode assembly comprising said electrode, a seal foil and a lead-in wire is prepared. The electrode assembly is introduced into an arc tube, the arc tube is closed with a seal and the electrode assembly is sealed therein, so that an arc chamber is created between the sealed portions. The surface irregularities of the electrode are formed in a region between the foil and the arc chamber.

In an exemplary embodiment of a further aspect of the invention, the electrodes are provided with at least one artificial surface irregularity after the step of preparing an electrode assembly comprising the electrode, the seal foil and the lead-in wire.

We found that the origin of the crack pattern is closely related to the location of the irregularity or irregularities. By the proper selection of the position of intentionally developed irregularity or irregularities on the electrode surface, the crack pattern can be controlled. A controlled crack pattern can efficiently reduce the probability of uncontrolled micro-crack propagation, and in this way, the development of early life lamp failures or lamp failures caused by residual mechanical stresses along the crack pattern.

The disclosed HID lamp allows avoiding the generation of unwanted crack structure that can propagate to the surface of the surrounding glass wall. The HID lamp and the method for manufacturing the lamp can be easily adapted to mass production and does not raise production costs significantly. The electrode structure can reliably control the shape of micro-cracks around the electrodes in order to establish a closed crack structure that will not lead to a leakage that could cause a short life of the lamps.

BRIEF DESCRIPTION OF DRAWINGS

The invention will now be described in more detail with reference to the enclosed drawing, in which.

DETAILED DESCRIPTION OF THE INVENTION

Figure 1:
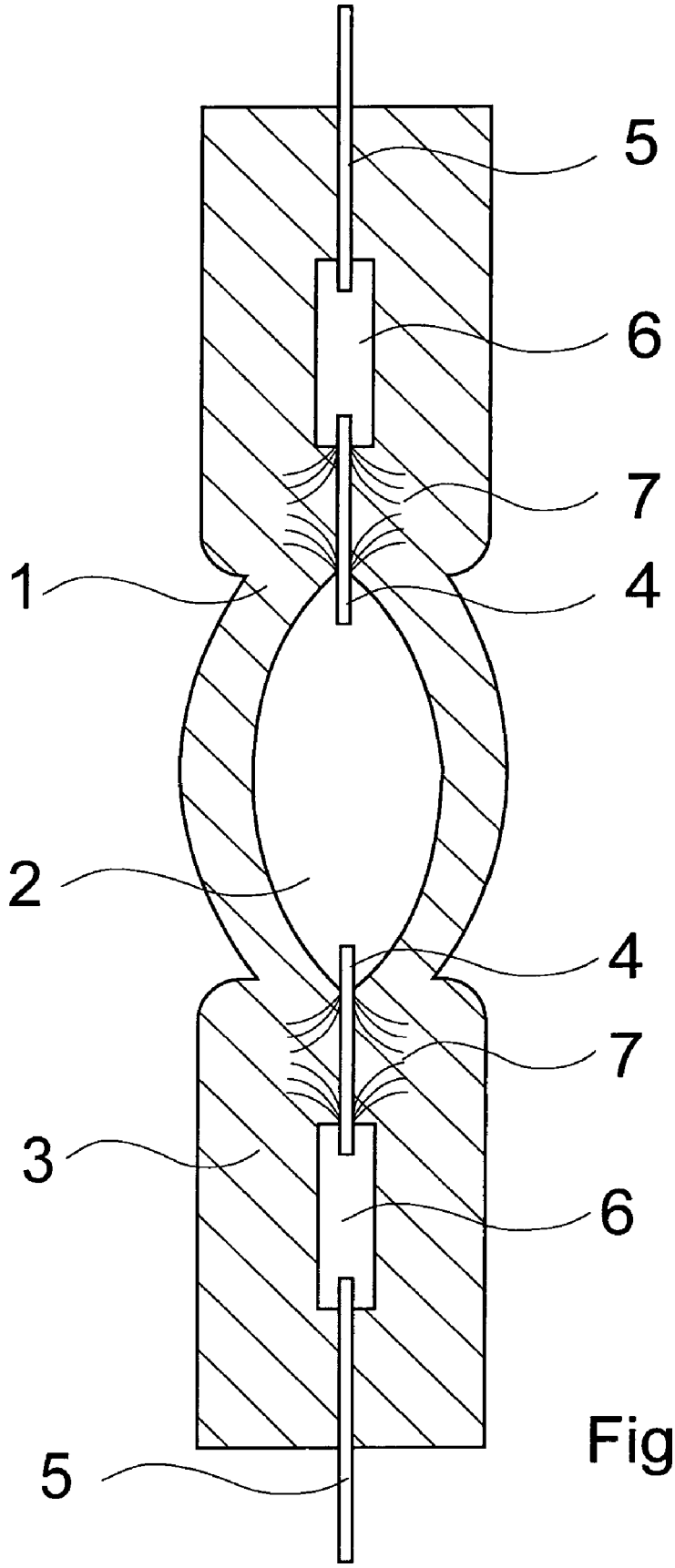
FIG. 1 is a top view of a prior art high intensity discharge lamp in cross section.

Referring now to FIG. 1, there is shown a high intensity discharge (HID) lamp as used in the automotive industry. The lamp has an arc tube in the form of a sealed lamp envelope 1, typically made of quartz or silica glass. The envelope 1 has a sealed inner volume defining an arc chamber 2 filled with a suitable gas, like argon, krypton or xenon. The arc tube is terminated at both ends in a gas tight manner with at least one of the termination comprising a sealed portion 3, the sealed portion enclosing an electrode assembly. The electrode assembly comprises an electrode 4 extending into the arc chamber 2, a lead-in wire 5 extending outward from the sealed portion 3 for providing electric contact with a power supply (not shown) and an electrically conducting seal foil 6 connecting the lead-in wire 5 and the electrode 4, the seal foil 6 providing a sealed electric connection through a sealed portion 3 of the arc tube. In FIG. 1, a HID lamp with a symmetrical structure with two substantially identical electrode assemblies is shown. Beside the shown example, there are many other different forms of HID lamps, which can serve as a basis for the present invention in the same way. The HID lamp may also be single ended with only one pinch or seal section with all electrode assemblies at one side with or without an auxiliary electrode for the starting process. Different from this symmetrical AC driven HID lamp, an asymmetrical DC driven HID lamp may have different electrode structures enclosed in the sealed sections.

During manufacturing of the HID lamp shown in FIG. 1, the electrode assembly is introduced axially into the open end of the discharge tube and held in this axial position while the end portion of the discharge tube is press-sealed or shrink-sealed in order to form a sealed portion. This sealing is accomplished at a temperature of about 2000-2500° C. After forming the seal, the glass is allowed to cool down. Due to its comparatively high linear thermal expansion coefficient, the electrode rod then contracts more rapidly than does the sealed portion of the glass tube in which it is embedded. This creates a micro-crack structure around the electrode rod. No such crack structure is created around the metal foil typically made of molybdenum because of the foil geometry. When an ignition circuit energizes this lamp, the temperature of the electrode rods rises steeply because of the high current flowing through the electrodes. The quartz glass of the sealed portion does not follow this temperature rise instantaneously. Due to the higher temperature and higher thermal expansion coefficient, the electrodes expand to a greater extent than the glass material does in the sealed portion. As a result of this, the electrodes will come into contact with the quartz glass and exert pressure on it. This pressure creates micro-cracks 7 in the wall of the sealed portion 3. These micro-cracks may expand in number and size and may propagate to the outer surface of the sealed portion 3 during subsequent ignition periods and result in lamp leakage. The prior art lamps due to this phenomenon have a relatively short lifetime especially if they are switched on and off frequently after short operation periods.

Figure 2:
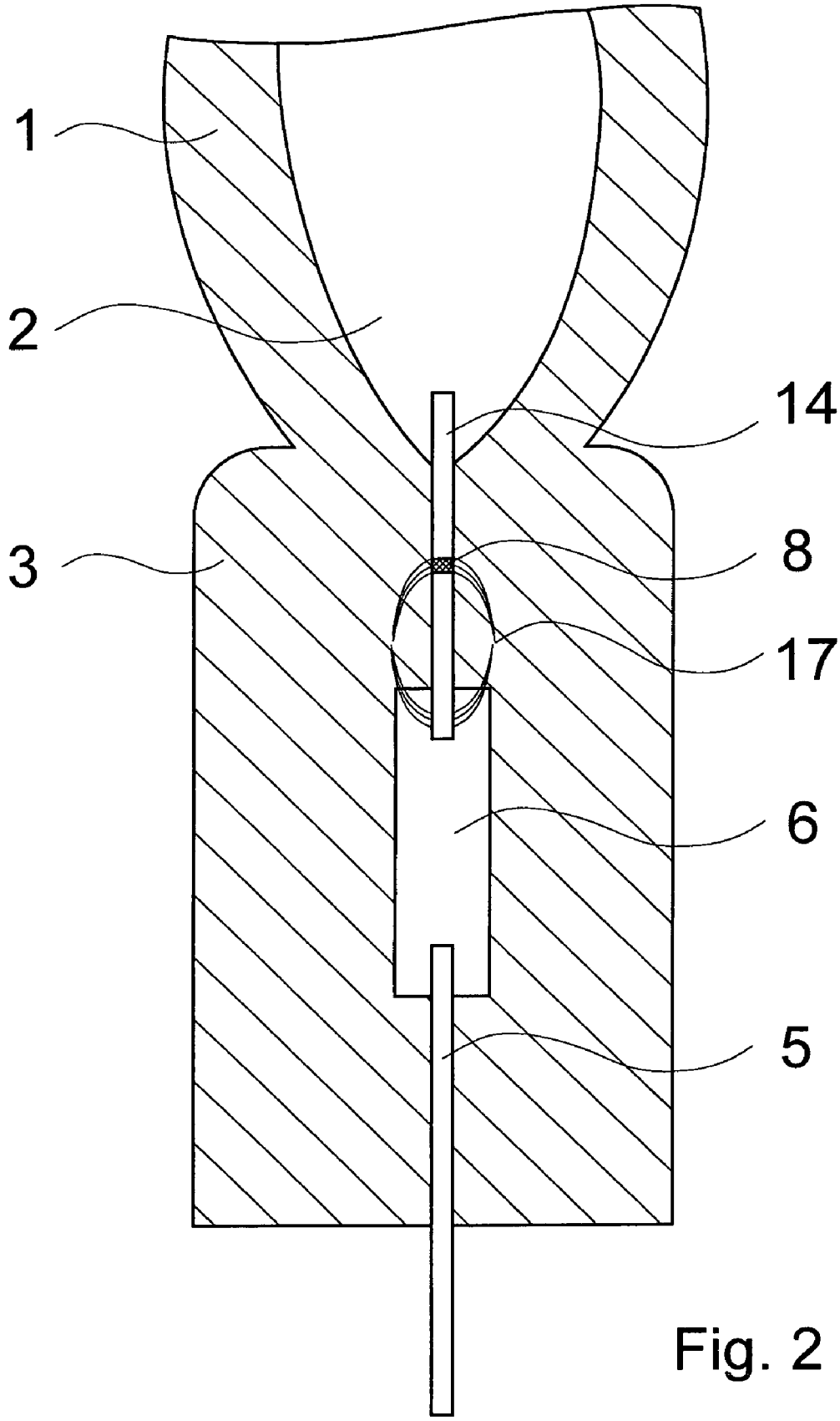
FIG. 2 is a partial top view of a high intensity discharge lamp with improved crack control in cross section.

FIG. 2 shows a HID lamp with improved crack control in a partial side view in cross section. The HID lamp of FIG. 2 has the same structure as the prior art lamp illustrated in FIG. 1 except for the electrodes. The electrodes 14 are provided with artificial surface irregularities 8 in order to control the shape and size of micro-cracks 17 in the seal wall. As it is shown, the surface irregularities 8 are formed on the surface of the electrodes 14 in a region "x" (measured for example from a terminal end of electrode in the arc chamber toward the seal foil) between the seal foil 6 and the arc chamber 2. These irregularities may be located at ¼ to ¾ of the distance between the seal foil 6 and the arc chamber 2. In this respect, said distance extends along the contact area between the electrode 14 and the seal wall from the inner end of the seal foil 6 to the beginning of the arc chamber 2. These irregularities 8 may also be located at ⅓ to ⅔ of the distance between the seal foil 6 and the arc chamber 2. In the shown embodiment, these irregularities 8 are located at about ½ of the distance between the seal foil 6 and the arc chamber 2. Through the use of artificial irregularities, the originating point of the micro-cracks 17 generated by heat and mechanical stress of the glass wall around the electrodes may be influenced and controlled. As we found, once such originating point is the location at the inner end of the seal foil and the outer end of the electrode. Selecting the location of the surface irregularities 8 creates a further originating point, and thereby the form and structure of the micro-cracks 17 may be controlled. At least one surface irregularity 8 may be sufficient for accomplishing the desired effect. At a location of about ¾ to ⅔ of the distance between the seal foil 6 and the arc chamber 2 nearer to the arc chamber, we found that the structure of the micro-cracks 17 changes and the micro-cracks tend to form a closed structure instead of an open one which lead to cracks propagating to the outer surface of the seal wall in prior art lamps. The nearer the location of the surface irregularities 8 to the inner end of the seal foil 6 is, the shorter is the distance for the micro-cracks 17 to build a closed structure. This distance however may not be selected less than ¼ to ⅓ of the distance between the seal foil 6 and the arc chamber nearer to the seal foil end because of the danger of building of a second micro-crack structure on the other side of the surface irregularities.

The following figures depict different embodiments of the electrode configuration that may be used in connection with the invention. FIGS. 3 to 6 show an electrode with a seal foil 6 connected to one end of the electrode. In the middle of the electrode, there is a surface irregularity.

Figure 3:
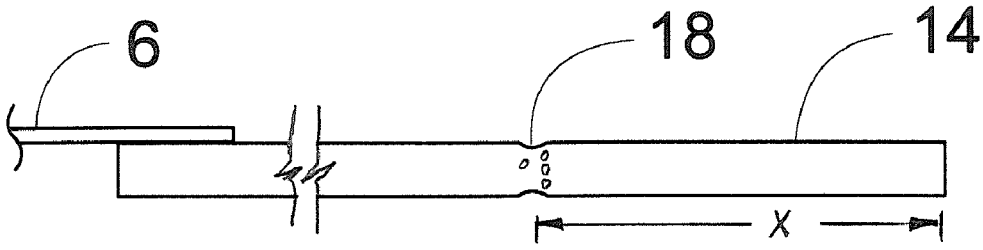
FIG. 3 is an enlarged side view of an electrode with irregularities in the form of holes.
Figure 4:
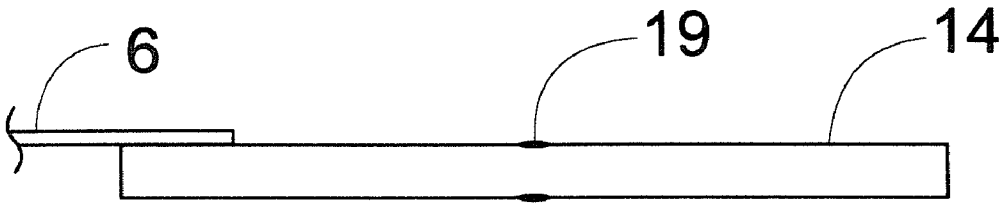
FIG. 4 is an enlarged side view of an electrode with irregularities in the form of protrusions.

At the electrodes shown in FIGS. 3 and 4, the surface irregularities are in the form of a spot that may be a hole 18 or a protrusion 19. As shown in FIG. 3 and 4, there are two spots (protrusions or holes) on opposite sides of the electrode. The number of the surface irregularities may also be three, four or even more. When two or more surface irregularities are used, it is advantageous to arrange them at equal distances from each other along a circumferential line. In order to achieve the desired effect of building of a short and closed crack structure at least one such spot has to be formed on the surface of the electrode in a region ¼ to ¾ of the distance between the seal foil and the arc chamber or preferably in a region ⅓ to ⅔ of the distance between the seal foil and the arc chamber. The size (width and/or the height or depth) of a spot is at least 1/10 of the largest cross sectional dimension of the electrode in order to achieve the desired effect. If the electrode is cylindrical, this dimension is its diameter.

Figure 5:
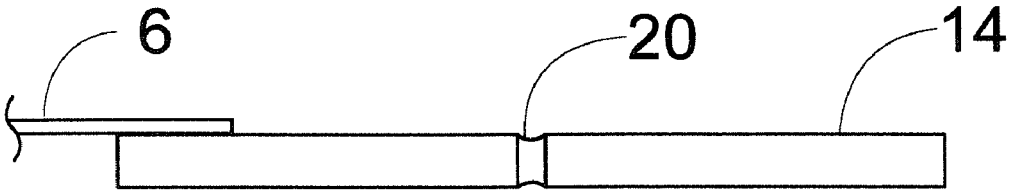
FIG. 5 is an enlarged side view of an electrode with irregularities in the form of a groove.
Figure 6:
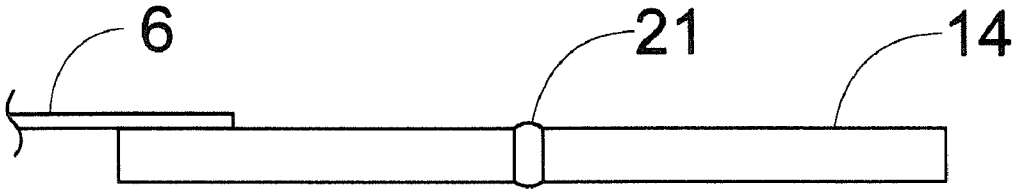
FIG. 6 is an enlarged side view of an electrode with irregularities in the form of a rib.

As shown in FIGS. 5 and 6, the electrode is provided with irregularities in the form of a circumferential surface area in a middle region on the surface of the electrode. As shown in FIG. 5, the electrode 14 may be provided with a circumferential groove 20. This groove 20 may have any cross sectional form and its surface is advantageously also irregular. In order to achieve the desired effect of building of a short and closed crack structure, the circumferential groove 20 has to be formed on the surface of the electrode in a region ¼ to ¾ of the distance between the seal foil and the arc chamber or preferably in a region ⅓ to ⅔ of the distance between the seal foil and the arc chamber. The size (width and/or the depth) of a groove 20 is at least 1/10 of the largest cross sectional dimension of the electrode in order to achieve the desired effect. As shown in FIG. 6, the electrode may be provided with a circumferential rib 21. This rib 21 may have any cross sectional form and its surface is advantageously also irregular. In order to achieve the desired effect of building of a short and closed crack structure, the rib 21 has to be formed on the surface of the electrode in a region ¼ to ¾ of the distance between the seal foil and the arc chamber or preferably in a region ⅓ to ⅔ of the distance between the seal foil and the arc chamber. The size (width and/or the height) of a rib 21 is at least 1/10 of the largest cross sectional dimension of the electrode in order to achieve the desired effect. The surface irregularities may be formed on the electrodes by any mechanical, chemical or heat treating process known in the art.

A method is also proposed for manufacturing a high intensity discharge lamp as described in connection with FIGS. 1 to 6. In an exemplary embodiment of this method, there is provided an electrode of predetermined length, geometry and structure. This electrode may have any geometry and structure, which can be used in a HID lamp. Electrodes for this purpose are well known in the prior art. An electrode assembly comprising said electrode, a seal foil and a lead-in wire is prepared in a process also well known in the art. The electrode used in connection with the invention is provided with at least one artificial surface irregularity in a region, which is terminated by the seal foil and the arc chamber in the HID lamp, respectively. Subsequently, the electrode assembly is introduced into an arc chamber and the arc chamber is closed with a press-seal or a shrink-seal by sealing the electrode assembly therein. The electrodes may be provided with at least one artificial surface irregularity also before the step of providing an electrode assembly comprising the electrode, the seal foil and the lead-in wire. Within the meaning of the invention, it is also possible to provide the electrodes with surface irregularities during the step of providing the electrodes with a predetermined geometry and structure, e.g. during separating the electrodes from an electrode wire. The surface irregularities may be formed on the electrodes before or after preparing the electrode assembly by any mechanical, chemical or heat treating process known in the art.

The invention is not limited to the shown and disclosed embodiments, but other elements, improvements and variations are also within the scope of the invention. For example, it is clear for those skilled in the art that beside the shown forms of surface irregularities any other forms may be suitable. Also the geometry and structure of the electrodes used in the HID lamp may be different from the shown examples.

The invention claimed is:

1. A high intensity discharge lamp comprising an arc tube enclosing an arc chamber containing a gas till, the arc tube being terminated by at least one sealed portion;

the at least one sealed portion enclosing an electrode assembly comprising at least one electrode extending into the arc chamber;

a lead-in wire extending outward from the scaled portion for providing electric contact with a power supply; and an electrically conducting seal foil connecting the lead-in wire and the at least one electrode, the conductor foil providing a sealed electric connection through the sealed portion of the arc tube, and at least one of the at least one electrode being provided with at least one artificial surface irregularity on an external surface thereof only in a region located approximately ¼ to ¾ of a distance between the foil and the arc chamber in order to control shape and size of cracks in a seal wall surrounding the at least one electrode, said artificial surface irregularity being provided without additional separate components.

2. The lamp of claim 1, in which the region of irregularities is located at ⅓ to ⅔ of the distance between the foil and the arc chamber.

3. The lamp of claim 1, in which the region of irregularities is located at about ½ of the distance between the foil and the arc chamber.

4. The lamp of claim 1, in which the irregularities are comprised of at least one spot.

5. The lamp of claim 4, in which the size of the spots of irregularities is at least 1/10 of the largest cross sectional dimension of the at least one electrode.

6. The lamp of claim 4, in which the spots of irregularities are formed as a hole on the surface of the at least one electrode.

7. The lamp of claim 1, in which the irregularities are comprised of a plurality of spots arranged along a circumferential line of the at least one electrode and substantially at an equal distance from each other.

8. The lamp of claim 7, in which the size of the spots of irregularities is at least 1/10 of the largest cross sectional dimension of the at least one electrode.

9. The lamp of claim 1, in which the irregularities are formed by a mechanical process.

10. The lamp of claim 1, in which the irregularities are formed by a chemical process.

11. The lamp of claim 1, in which the irregularities are formed by a heat treating process.

12. The lamp of claim 1, in which the size of the spots of irregularities is at least 1/10 of the largest cross sectional dimension of the at least one electrode.

13. A method for manufacturing a high intensity discharge lamp comprising the steps of providing an electrode of predetermined length, geometry and structure;

providing the electrode with at least one surface irregularity on an external surface of the electrode without additional separate components;

preparing an electrode assembly comprising the electrode, a seal foil and a lead-in wire;

introducing the electrode assembly into an arc tube; and closing the arc tube with a seal by sealing the electrode assembly therein, and thereby creating an arc chamber between the sealed portions, so that the surface irregularities of the electrode are formed only in a region located approximately ¼ to ¾ of a distance between the foil and the arc chamber.

14. The method of claim 13, in which the region of irregularities is located at ⅓ to ⅔ of the distance between the foil and the arc chamber.

15. The method of claim 13, in which the region of irregularities is located at about ½ of the distance between the foil and the arc chamber.

16. The method of claim 13, in which the irregularities are formed of at least one spot.

17. The method of claim 16, in which the size of the spots of irregularities is at least 1/10 of the largest cross sectional dimension of the electrode.

18. The method of claim 16, in which the spots of irregularities are formed as a hole on the surface of the electrode.

19. The method of claim 13, in which the irregularities are formed of a plurality of spots arranged along a circle and substantially in an equal distance from each other.

20. The method of claim 19, in which the size of the spots of irregularities is at least 1/10 of the largest cross sectional dimension of the electrode.

21. The method of claim 13, in which the irregularities are formed by a mechanical process.

22. The method of claim 13, in which the irregularities are formed by a chemical process.

23. The method of claim 13, in which the irregularities are formed by a heat treating process.

24. A method for manufacturing a high intensity discharge lamp comprising the steps of providing an electrode of predetermined length, geometry and structure;

preparing an electrode assembly comprising said electrode, a seal foil and a lead-in wire;

providing the electrode with at least one artificial surface irregularity directly on an external surface of the electrode;

introducing the electrode assembly into an arc tube; and closing the arc tube with a seal by sealing the electrode assembly therein, and thereby creating an arc chamber between the sealed portions, so that the surface irregularities of the electrode are provided without additional separate components and are formed only in a region between the foil and the arc chamber located at approximately ¼ to ¾ of a distance therebetween and the size of the irregularities are at least one-tenth of the largest cross-sectional dimension of the electrode.

* * * * *